US005878755A

United States Patent [19]

Crabtree et al.

[11] Patent Number: 5,878,755

[45] **Date of Patent: *Mar. 9, 1999**

[54] HELICAL HAIR WRAP DEVICE

[76] Inventors: Paul E. Crabtree, 4110 SE. 62nd Ave., Portland, Oreg. 97206; Barbara Mundell, 5220 S. Smugglers Cove, Freeland, Wash. 98249

[ * ] Notice: This patent issued on a continued prosecution application filed under 37 CFR 1.53(d), and is subject to the twenty year patent term provisions of 35 U.S.C. 154(a)(2).

[21] Appl. No.: 719,920

[22] Filed: Sep. 25, 1996

[51] Int. Cl.[6] ..... A45D 8/36

[52] U.S. Cl. ..... 132/273

[58] Field of Search ..... 132/273, 275, 132/280, 333, 212; 267/166

[56] References Cited

U.S. PATENT DOCUMENTS

| | | | |
|---|---|---|---|
| 482,257 | 9/1892 | Larkin | 132/280 |
| 2,924,228 | 2/1960 | McGee | 132/273 |
| 3,247,856 | 4/1966 | Weeks | 132/273 |
| 4,892,110 | 1/1990 | Harvie | 132/273 |
| 5,271,421 | 12/1993 | Videtzky | 132/280 |
| 5,318,054 | 6/1994 | Neilson et al. | 132/273 |
| 5,495,861 | 3/1996 | Liberman | 132/273 |

FOREIGN PATENT DOCUMENTS

| | | | |
|---|---|---|---|
| 467741 | 6/1914 | France | 132/280 |
| 21486 | 9/1910 | United Kingdom | 132/273 |

*Primary Examiner*—Todd E. Manahan
*Attorney, Agent, or Firm*—Donald E. Zinn

[57] ABSTRACT

The present invention provides a device for holding hair in a bundle securely. The device consists of a cylindrical coiled shape with pitch slightly larger than inside diameter, made with a material of sufficient rigidity as to not flex. A bundle of hair, smaller than the pitch, yet larger than the inside diameter is inserted into a pitch gap and the bundle wound into the device until the hair is contained by the cylinder formed by the coils. The hair springs against the device, friction holding it in place. The device may then become a means to attach other ornaments which hang from the coil as additional adornments for the hair. Additionally, the coil itself may itself be decorated on the outside surface.

1 Claim, 1 Drawing Sheet

HELICAL HAIR WRAP DEVICE

BACKGROUND OF THE INVENTION

1. Field of the Invention

This invention relates to mechanical devices for the purpose of securing hair in a bundle 2. Description of the Prior Art Devices for holding or ornamenting the hair have been used for literally thousands of years. Those for bundling the hair are usually elastic bands or flat clips or bendable devices of malleable materials or other such mechanical devices with movable parts or which change shape. Devices of this type require elastic qualities or springs or that they be deformed with each use of the device or other energy storing means which apply pressure to the hair bundle. The same pressure which secures the bundle of hair can damage the hair or entangle the hair which along with the damage can cause discomfort upon removal. Furthermore, these devices rely on moving, stretching or bendable parts, which can break or wear out.

There is no known prior art which teaches a method of holding hair by means of a rigid or semi-rigid helix in bundles without undo pressure or moving parts and is removed easily by "unscrewing" the device as with the present invention.

OBJECTIVES AND ADVANTAGES

Accordingly the objectives of this invention are to provide:

(1) A means for securing bundles of hair with a helical device that requires no moving parts.

(2) A device which by its unique geometry is easily placed around the hair bundle.

(3) A device which by its unique geometry is easily removed from said hair bundle without damage to the hair or discomfort to the user.

(4) A device which additionally can have a variety of materials and or surface treatments.

(5) A device which can additionally provide the means for hanging various adornments there from.

SUMMARY OF THE INVENTION

The objectives of this invention are achieved as follows:

In a typical embodiment of the invention, a rigid or semi-rigid material is formed into a helix. The helix must have a clear dimension at the pitch opening which is greater than the clear inside diameter of the helix.

BRIEF DESCRIPTION OF THE DRAWINGS

The invention will be more fully comprehended from the following detailed description and accompanying drawings in which.

DETAILED DESCRIPTION

Figure 1A:
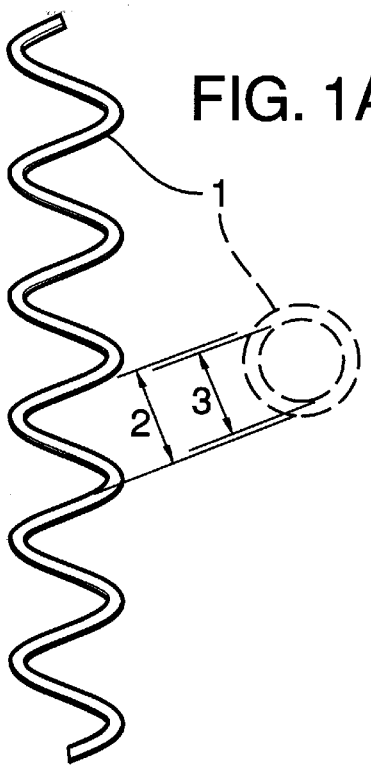
FIG. 1A is a side view of this invention in combination with a ghosted end view of the invention, indicating a necessary relationship of pitch opening to the inside diameter of the helix.
Figure 1B:
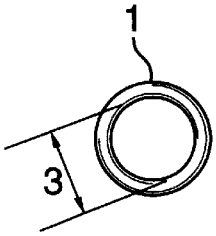
FIG. 1B is an end view of this invention, indicating the inside diameter of the helix.

Referring now to FIG. 1A and FIG. 1B, the relationship of pitch opening 2 to inside diameter 3 is depicted. In this example a helix of six revolutions 1 is depicted, but the exact number of revolutions is quite variable and no fixed dimension is required as long as the required relationship wherein the pitch opening 2 is greater than the inside diameter 3 is maintained.

Figure 2:
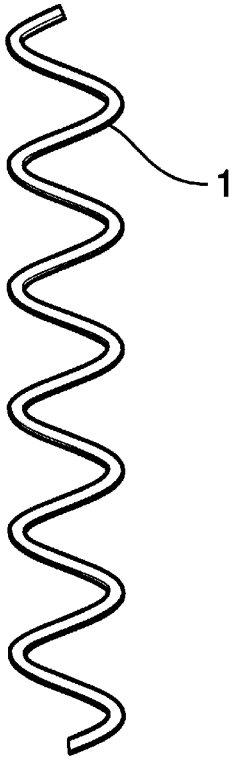
FIG. 2 is a three dimensional side view of the invention.

Referring now to FIG. 2, a three dimensional view of the invention 1 is depicted.

Figure 3:
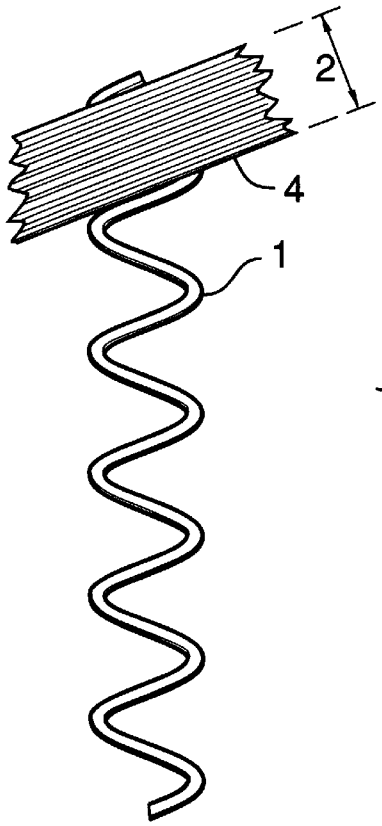
FIG. 3 is a the same view as FIG. 2 with a bundle of hair being started into the helix.

Referring now to FIG. 3, a bundle of hair 4 being inserted into a pitch opening 2 of the invention 1 is depicted.

Figure 4:
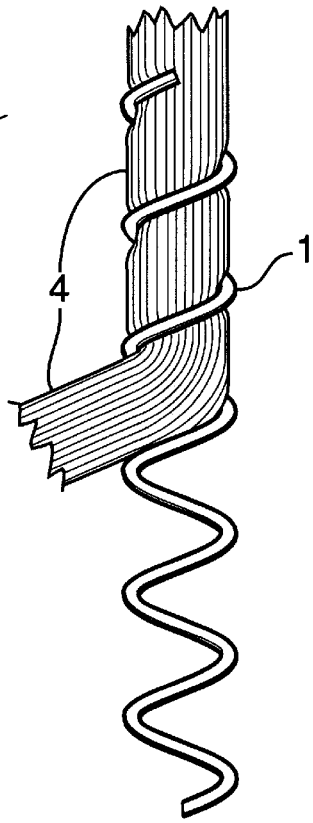
FIG. 4 is a the same view as FIG. 2 with a bundle of hair partially wound into the helix.

Referring now to FIG. 4, a bundle of hair 4 having been partially wound into the invention 1 is depicted.

Figure 5:
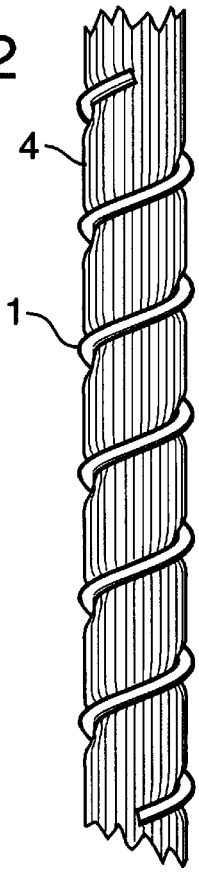
FIG. 5 is a the same view as FIG. 2 with a bundle of hair fully held by the helix.

Referring now to FIG. 5, a bundle of hair 4 fully secured by the invention 1 is depicted.

The invention has other potential applications and those skilled in the art can find other fields of use. For example, various surface conditions can become a decoration of the invention; the invention may become the means of support for various objects to be hung from or otherwise attached to the invention; bundles of animal hair, synthetic hair or the hair of dolls may be bundled in similar devices; various bundles of fibers not related to hair or animals may be bundled in such devices.

What is claimed is:

1. An elongated helical hair holding device consisting of a single open-ended helix of rigid material having longitudinally equally spaced helical turns and being axially unobstructed over the length of the helix and having pitch openings between adjacent turns larger than the inside diameter of said helix, whereby a wrap bundle of hair having a diameter less than the pitch opening and in excess of the helix inner diameter may be self-supported within the interior of the helix by the friction of the released bundle of hair after having been threaded sequentially through said pitch openings of said helix over the axial length of said device.

* * * * *